US005784721A

United States Patent [19]

Huff

[11] Patent Number: 5,784,721

[45] Date of Patent: Jul. 28, 1998

[54] PADDED FLEECE SOCK AND METHOD OF MAKING SAME

[75] Inventor: Frances M. Huff, Jackson Hole, Wyo.

[73] Assignee: Wyoming Woolens, Jackson Hole, Wyo.

[21] Appl. No.: 698,873

[22] Filed: Aug. 15, 1996

[51] Int. Cl.[6] ..... A41B 11/00

[52] U.S. Cl. ..... 2/239; 2/241

[58] Field of Search ..... 2/239, 241, 409; 66/178 A, 178 R, 182, 185, 188, 194

[56] References Cited

U.S. PATENT DOCUMENTS

| | | | |
|---|---|---|---|
| 3,003,154 | 10/1961 | Litman | 2/239 |
| 3,266,058 | 8/1966 | Guttman | 2/239 |
| 3,793,851 | 2/1974 | Thorneburg . | |
| 4,194,249 | 3/1980 | Thorneburg . | |
| 4,253,317 | 3/1981 | Howard . | |
| 4,255,949 | 3/1981 | Thorneburg . | |
| 4,373,361 | 2/1983 | Thorneburg . | |
| 4,422,307 | 12/1983 | Thorneburg . | |
| 5,095,548 | 3/1992 | Chesebro, Jr. . | |
| 5,307,522 | 5/1994 | Throneburg et al. . | |

FOREIGN PATENT DOCUMENTS

| | | | |
|---|---|---|---|
| 1509998 | 12/1967 | France | 2/239 |

OTHER PUBLICATIONS

Patagonia Catalog–Functional Kids Clothes Spring pp. 30,33 & 38 Mar. 1991.

Patagonia, Fall/Winter Sep. 1991 pp. 21,30,42,43,52,53,55, 56,65 & 70 Sep 1991.

*Primary Examiner*—Gloria M. Hale
*Attorney, Agent, or Firm*—Welsh & Katz, Ltd.

[57] ABSTRACT

A padded sock made from blanks of spun polyester fleece material and having flatlock seams is lightweight and quick-drying and provides improved warmth, comfort and a contour fit without causing blisters or the like. In one embodiment, the sock is made from a first single-piece generally rectangular blank or pattern of fleece material and has peripheral marginal edges selectively secured in juxtaposed relation by a flatlock seam to define a foot receiving portion and a leg encompassing portion. Additional shorter length blanks of the fleece material have laterally opposite marginal edges secured in juxtaposed relation to the marginal edges of the first blank by the flatlock seams so as to provide padded toe and heel regions and at least one shin pad area, thereby substantially improving comfort when the sock is worn with many types of outdoor footwear.

16 Claims, 1 Drawing Sheet

PADDED FLEECE SOCK AND METHOD OF MAKING SAME

BACKGROUND OF THE INVENTION

The present invention relates generally to socks, and more particularly to a novel padded sock construction and method of manufacture which provides improved warmth and comfort over prior sock constructions.

With increasing interest in outdoor camping and sporting activities, such as hiking, rafting, kayaking and cross country skiing and the like where both cold and wet conditions are commonly encountered, maintaining one's feet warm and comfortable is of major importance. With almost all activities of this type, the participant's feet may become wet or damp and cold by exposure to external sources of cold water, or by perspiration that is captured in the socks. In all cases, it is important that the socks be capable of quick drying while also providing desired warmth and comfort.

Socks presently available which are particularly intended to be worn in environments where the wearer's feet may be exposed to adverse conditions, such as in the aforedescribed outdoor activities, are generally made from a knit material, such as disclosed in U.S. Pat. Nos. 1,418,617, 1,752,587, 3,122,906 and 4,422,307. It is also proposed to make socks from a composite material, such as disclosed in U.S. Pat. No. 5,020,164, or from a material knit from a body yarn in successive courses with hydrophobic and hydrophilic yarns knit in plated relation with the body yarn, such as disclosed in U.S. Pat. No. 5,095,548.

In all known prior sock constructions having one or more sewn seams which interconnect one or more knitted blanks or panels to create the finished sock, the seam creates a raised ridge which can cause blisters where it engages the foot. In addition to the discomfort of such socks, the blister may break and become infected, particularly where the socks are worn under conditions where exposure to infection is not easily prevented. Another cause of discomfort with known sock constructions results from failure to provide sufficient padding to withstand the rigors and impact of prolonged outdoor activities that require the wearing of relatively heavy and bulky footwear such as hiking boots, ski boots, and other footwear extending above the ankle. Accordingly, a relatively lightweight sock made of a material which provides desired warmth even when damp, is capable of relatively quick drying, affords a comfortable contoured fit, eliminates conventional raised seam stitching and provides improved padding would provide significant advantages over known sock constructions, particularly where intended for use in the aforedescribed activities.

SUMMARY OF THE INVENTION

A general object of the present invention is to provide a novel padded sock construction and method of manufacture which results in a lightweight, breathable and quick drying sock having improved warmth and padded comfort over prior socks.

Another object of the present invention is to provide a novel sock construction wherein the sock is made from blanks of spun polyester fleece material and utilizes flatlock seams so as to eliminate conventional raised sewn seams and provide significantly improved padding for comfort and warmth.

A more particular object of the present invention is to provide a novel sock construction and method of manufacture wherein the sock is made from a plurality of blanks or patterns of spun fleece material such that the blanks have a predetermined laterally opposite longitudinal marginal edges interconnected by flatlock seams to form foot receiving and leg encompassing portions of the sock and establish padded regions adjacent the toe and heel areas and preferably at the forward facing leg encompassing portion of the sock.

A feature of one embodiment of a sock and its method of manufacture in accordance with the present invention lies in providing a first single-piece substantially rectangular blank or pattern of spun fleece material having substantially parallel longitudinal marginal edges in which first and second pairs of laterally opposed generally V-shaped dart cuts are formed, providing second and third shorter length blanks of the fleece material having longitudinal marginal edges adapted to be selectively positioned in juxtaposed relation to the longitudinal marginal edges of the first blank, securing the second and third blanks in superimposed relation on the first blank, folding the first blank generally transversely so that the longitudinal marginal edges and dart cut marginal edges of the various blanks are in mutually juxtaposed relation, and securing the juxtaposed marginal edges together by flatlock seams so as to form foot receiving and leg encompassing sock portions without utilizing conventional raised stitched seams in any portion of the sock which engages the wearer's foot and with padded regions being provided adjacent at least the toe and heel areas of the sock.

A feature of the sock construction in accordance with a preferred embodiment of present invention lies in providing a knitted expansion control band about the foot receiving opening of the fleece material sock body to maintain the sock in relatively fixed relation on the wearer's foot and leg.

Further objects, features and advantages of the present invention will become apparent from the following detailed description when taken in conjunction with the accompanying drawings wherein like reference numerals designate like elements throughout the several views.

DETAILED DESCRIPTION

Figure 1:
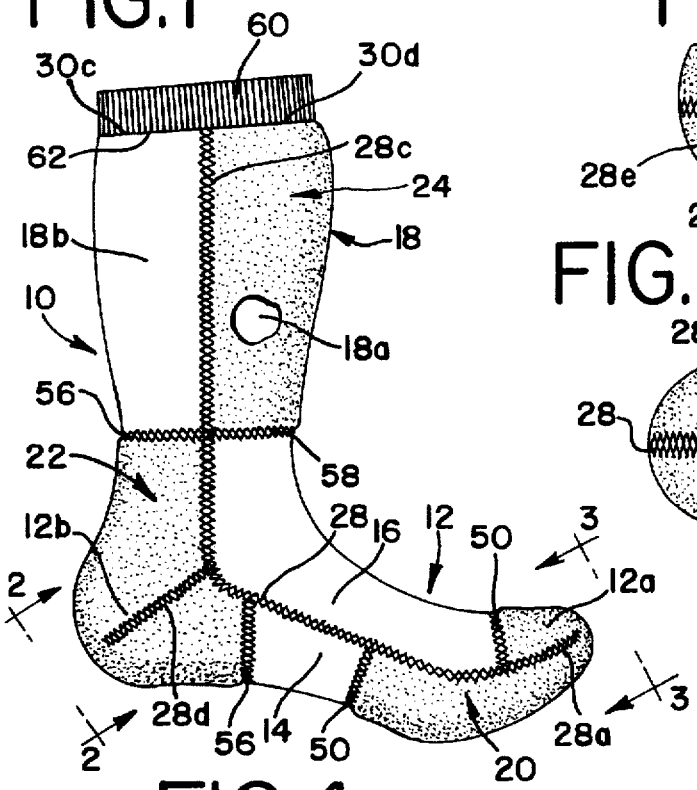
FIG. 1 is a side elevational view of a sock constructed in accordance with the present invention.

Referring now to the drawing, a sock constructed in accordance with a preferred embodiment of the present invention is illustrated in FIG. 1 and indicated generally at 10. The sock 10 is adapted to be worn on one's foot and includes a foot receiving portion 12 having a toe end pocket 12*a* and a heel end pocket 12*b*. The foot receiving portion 12 of the sock is bounded along its lower surface by a sole panel 14 which underlies the wearer's foot, and is bounded along its upper surface by an upper panel 16 which generally overlies and engages the upper surface of the wearer's foot. A tubular portion 18 of the sock extends generally upwardly from the foot receiving portion 12 and is adapted to encompass the lower portion of the wearer's leg, preferably from the ankle to just below the knee, thereby extending upwardly over the wearer's calf and shin. As will be described, the sock 10 has padded regions in the toe and heel areas, indicated at 20 and 22, respectively, and forwardly of the leg encompassing portion 18, indicated at 24, so as to provide a pad forwardly of the wearer's shin.

In accordance with one feature of the sock 10, the sock, including the padded regions 20, 22 and 24, is made from a spun fleece material with substantially all seams, and particularly the seams forming the foot receiving portion 12, being flatlock stitched seams, as contrasted with conventional stitched seams which establish raised ridge-like seams. The fleece material preferably comprises 100% spun polyester fabric having small air pockets throughout the material which trap air and create an insulating barrier. The fleece material is relatively light in weight and made highly breathable, even when damp. The fleece material is formed with a relatively upright velour pile that provides a soft stretchable fit and contours well to the wearer's foot. The fleece material is selected to exhibit high wicking characteristics so as to dry quickly while being worn or when removed from the foot. The fleece material preferably has a moisture vapor transmission factor of approximately 900 grams per square meter over a 24 hour time period, and has an air permeability factor (under ASTM D737-15) of 247 cubic feet of air per square foot of fabric area per minute (equivalent to 125 $cm^3/cm^2/sec.$). The fleece material preferably has an diathermic insulation factor (under ASTM D1518) which provides a Clo rating of approximately 1.2 (equivalent to a Tog rating of approximately 1.66). The material also preferably has a weight or density in the range of approximately 7.8 $oz./yd^2$–8.1 $oz./yd^2$. A fleece material having the aforedescribed characteristics and an average stretch (ASTM D2594) in the width direction (circumferential direction in the sock 10) of 90 percent may be obtained from Malden Mills Industries, Inc. under its Polartec™ Series 200 brand. Malden Mills Polartec™ Series 100 fleece material may also be used.

Figure 5:
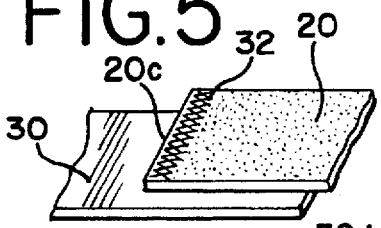
FIG. 5 is a fragmentary perspective view illustrating a flatlock seam of the type employed in the present invention.
Figure 4:
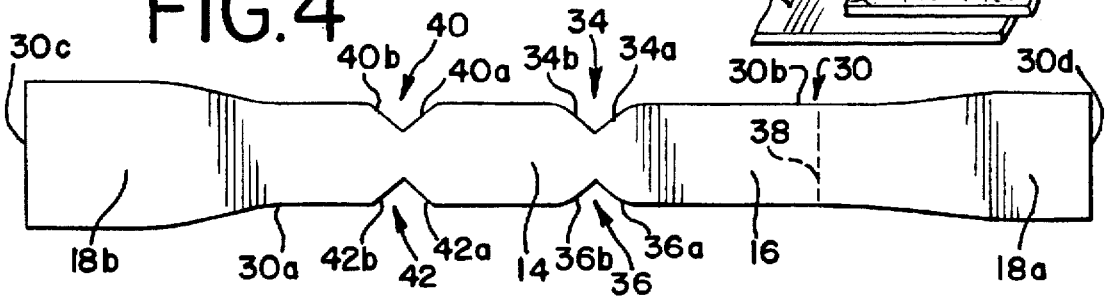
FIG. 4 is a plan view of a first blank or pattern employed in making the sock of FIG. 1.

As aforementioned, preferably all seams in the sock 10, and particularly longitudinal seams which extend along laterally opposite sides of the socks, one of which is indicated at 28 in FIG. 1, are of the flatlock seam type so as not to create any raised seams in the portions of the sock which are disposed between the wearer's foot, ankle and leg and any outer footwear such as a shoe or boot or the like. FIG. 5 illustrates a flatlock seam of the flatlock overlapping type preferably employed in the present invention to secure transverse end edges of the pads 20, 22 and 24 to a first or primary blank or substrate 30 of fleece material as will be described. As shown, for example, a marginal transverse edge 20*c* of the pad blank 20 is secured to the fleece blank 30 by a flatlock seam 32 comprised of a four-needle, six thread flatlock seam sewn along the overlapping marginal edge of the pad 20 to create a flatlock overlapping seam. Preferably, in forming the sock 10 from the first or primary blank 30 of fleece material as shown in FIG. 4, the laterally opposite longitudinal marginal edges of the primary blank, and also the pad blanks 20, 22 and 24 are disposed in edge-to-edge butting relation and the flatlock seam formed so as to extend through each abutting marginal edge and across the butt joint. Machinery for forming such flatlock seams is commercially available.

The sock 10 is made from a single-piece rectangular first or primary blank or pattern, indicated generally at 30 in FIG. 4, of the fleece material. The blank or pattern 30 has generally parallel but contoured laterally opposite longitudinal marginal edges 30*a* and 30*b* and transverse marginal end edges 30*c* and 30*d*. A first pair of laterally opposed generally V-shaped dart cuts 34 and 36 are formed in the longitudinal marginal edges 30*a* and 30*b* of the blank 30, such as indicated by V-shaped marginal edges 342*a,b* and 362*a,b* defining the dart cuts 34 and 36, respectively. The dart cuts 34 and 36 are spaced a predetermined distance from the transverse end edge 30*d* of the blank 30 so as to establish the panel 16 which will form the upper panel of the foot receiving sock portion 12 and a contiguous panel 18*a* which extends generally from a transverse line, indicated in phantom at 38, to the end edge 30*d* and will form a forward panel of the leg encompassing portion 18 of the sock. The dart cuts 34 and 36 are formed so that their respective marginal edges 342*a,b* and 362*a,b* intersect the corresponding longitudinal marginal edges 30*a* and 30*b* of the first blank or pattern 30 through radially curved convex corners which form the generally rounded toe pocket end 12*a* of the sock.

A second pair of laterally opposed generally V-shaped dart cuts 40 and 42 are formed in the longitudinal marginal edges 302*a,b* of the blank spaced longitudinally from the dart cuts 34 and 36. The dart cuts 40 and 42 are similarly defined by generally V-shaped marginal edges 402*a,b* and 422*a,b* respectively. The dart cuts 40 and 42 are spaced longitudinally from the dart cuts 34 and 36 a predetermined distance so as to establish the desired length sole panel 14 and establish the heel end pocket 12*b* of the assembled sock. The longitudinal length of the blank 30 is selected so that the transverse end edge 30*c* is spaced from the dart cuts 40 and 42 a distance sufficient to place the end edge 30*c* in juxtaposed relation to the opposite transverse end edge 30*d* when the blank is folded transversely about fold lines connecting the vertices of each opposed pair of dart cuts 34,36 and 40,42, thereby establishing the rear panel 18*b* of the leg encompassing portion 18 of the sock. The dart cuts 34, 36, 40 and 42 have an included vertex angle in the range of approximately 60 to 70 degrees, although other dart cut vertex angles could also be used.

Figure 6:
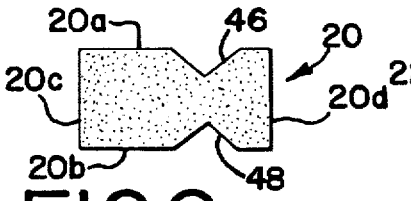
FIGS. 6–8 are plan views illustrating three blanks or patterns for creating padded regions in the toe, heel and shin areas of the sock of FIG. 1.
Figure 9:
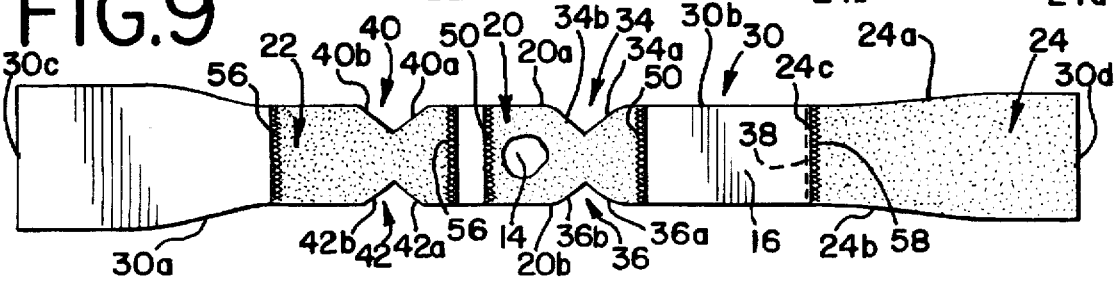
FIG. 9 is a plan view of the blank of FIG. 4 but showing the pad blanks of FIGS. 6–8 secured thereon before folding and securing the juxtaposed longitudinal marginal edges to form the sock of FIG. 1.

Referring to FIGS. 6–9, the pad blanks 20, 22 and 24 are formed as single-piece blanks preferably from a fleece material available from Malden Mills as its 200 wt. Ecotech™ fleece material. The pads 20, 22 and 24 are referred to as the second or toe pad 20, the third or heel pad 22, and the fourth or shin pad 24. As shown in FIG. 6, the second pad 20 is made as a single-piece blank having laterally opposite longitudinal marginal edges 20*a* and 20*b*, and transverse marginal end edges 20*c* and 20*d*. A pair of laterally opposite V-shaped dart cuts 46 and 48 are formed in the pad 20 so that the pad 20 may be positioned in superimposed relation on the blank 30 with the marginal edges 20*a* and 20*b* and dart cut edges in juxtaposed relation to the marginal edges 30*a* and 30*b* and edges of the dart cuts 34 and 36, as shown in FIG. 9. The transverse end edges of pad 20 are then secured to the blank 30 through flatlock seams as indicated at 50.

Figure 7:
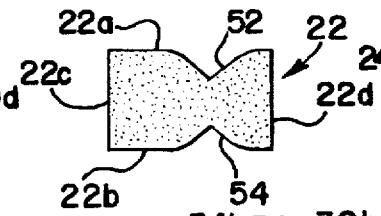
Figure 8:
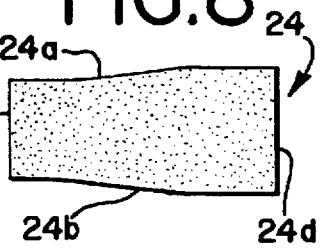

FIG. 7 illustrates the third or heel pad 22 that is also made from a single-piece blank of fleece material similar to pad 20. The pad 22 similarly has longitudinal marginal edges 22*a* and 22*b* and transverse marginal end edges 22*c* and 22*d*. Pad 22 also has V-shaped dart cuts 52 and 54 formed in its longitudinal marginal edges so that pad 22 may be positioned in superimposed relation on blank 30 with the edges of the dart cuts 52 and 54 in juxtaposed relation to the dart cuts 40 and 42. When so positioned, the end edges 22*c* and 22*d* of pad 22 are secured to blank 30 by flatlock seams as indicated at 56 in FIG. 9.

The forth pad 24, termed the shin pad, is made from a single-piece rectangular blank of fleece material similar to pads 20 and 22. The pad 24 is configured so that when placed in superimposed relation on the blank 30, as shown in FIG. 9, longitudinal marginal edge 24*a* and 24*b* will lie in juxtaposed relation to the contoured longitudinal marginal edges of blank 30. A transverse end edge 24*c* of pad 24 is then secured to the blank 30 by a flatlock seam 58.

Figure 2:
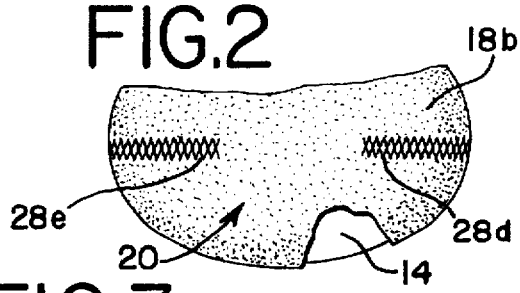
FIG. 2 is a fragmentary view taken substantially along line 2—2 of FIG. 1 illustrating the heel pocket of the sock.
Figure 3:
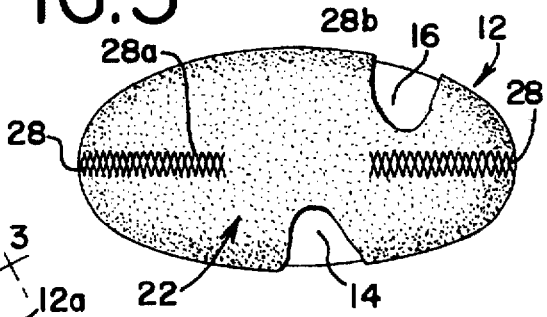
FIG. 3 is a fragmentary view taken substantially along line 3—3 of FIG. 1 illustrating the toe pocket of the sock.

In making the preferred embodiment of sock 10 from the blank or pattern 30, having the pads 20, 22 and 24 secured thereon as described, the blank is first folded about a transverse fold line interconnecting the vertices of the opposed dart cuts 40 and 42 such that the longitudinal marginal edges of each dart cut 40, 42 and the corresponding dart cuts in the pad 22 are in juxtaposed relation. The juxtaposed edges of the corresponding dart cuts 40, 42 and 52, 54 are then secured by flatlock seams initiated at the vertices of the dart cuts, as indicated by flatlock seams 28*d* and 28*e* in FIG. 2. After stitching the dart cuts 40, 42 and 52, 54 by seams 28*d* and 28*e*, the blank 30 and attached pads 20 and 24 is folded about a fold line between the vertices of dart cuts 34 and 36 so that the longitudinal marginal edges of the panels 14 and 16 are in juxtaposed relation, and the marginal edges of the dart cuts 34, 36 and 46, 48 are disposed in similar juxtaposed relation to each other. The juxtaposed marginal edges are then secured together by flatlock sewn seams starting from the apex of each forward toe end dart cut, as indicated at 28*a* and 28*b* in FIG. 3, and extending along the juxtaposed panels 14 and 16. At this point, the panels 18*a* and 18*b* are positioned in juxtaposed relation such that their corresponding longitudinal marginal edges are disposed in similar edge-to-edge relation along with the marginal edges of pad 24. The flatlock seams 28 on opposite sides of the sock are continued along the lengths of the opposed panels 18*a* and 18*b* to their upper ends, as indicated at 28*c* in FIG. 1 to close the side edges of the panels and dart cuts. Alternatively, it may be desirable to secure the longitudinal marginal edges of the panels and dart cuts in overlapping relation by flatlock seams.

After the blank or pattern 30 has been formed into the aforedescribed partially completed sock, an endless annular elastic fabric band or collar 60 of known construction is preferably secured to the juxtaposed end edges 30*c,d* of the blank 30 and to the upper free edge 24*d* of pad 24. The band or collar 60 may be secured to the end edges 32*c,d* and 24*d* by a conventional stitched seam, such as indicated at 62, and is capable of hugging the wearer's leg above the shin region to prevent the leg encompassing portion 18 of the sock from falling down when worn.

Thus, in accordance with the present invention, a novel padded sock construction and method of making the padded sock are provided wherein the sock is made from a primary single-piece blank of spun polyester fleece material folded transversely about itself and having juxtaposed longitudinal marginal edges closed by flatlock seams. The fleece material eliminates blistering of the feet as frequently experienced with conventional warp and weft-knitted fabric material. The flatlock seams, whether of the preferred flatlock abutting edge type or of a flatlock overlapping joint type, eliminate raised sewn seams as in prior sock constructions, thereby further reducing the chance for blistering. The fleece material, through its minute air pockets and significant wicking action, provides increased warmth even when the socks are damp or wet, and reduces drying time. The fleece material is lightweight and stretchable and thereby enables a comfortable contour fit which cannot be achieved with conventional knitted sock fabrics that have very little stretchability, if any. The provision of fleece pads at the toe, heel and shin regions of the sock protect the wearer against the impact of prolonged walking, hiking and trekking in outdoor activity type footwear.

While a preferred embodiment of the present invention have been illustrated and described, it will be understood to those skilled in the art that changes and modifications may be made therein without departing from the invention in its broader aspects. Various features of the invention are defined in the following claims.

What is claimed is:

1. A method for making a padded sock comprising the steps of:

a) forming a first single-piece generally rectangular blank of polyester fleece material having generally parallel longitudinal marginal edges and first and second pairs of laterally opposed dart cuts formed in said longitudinal marginal edges intermediate the length of the blank, b) forming a second single-piece blank of polyester fleece material having laterally opposite longitudinal marginal edges and a pair of laterally opposed dart cuts formed in said marginal edges so as to enable said second blank to be placed in superimposed relation on said first blank with the longitudinal marginal edges and dart cuts of the second blank in juxtaposed relation with longitudinal marginal edges and a first pair of dart cuts on said first blank, said second blank having substantially transverse marginal end edges, c) positioning said second blank in said superimposed relation on said first blank and securing said marginal end edges of said second blank to said first blank by stitched seams disposed generally transverse to said longitudinal marginal edges of said first blank, d) folding said first blank generally transversely of itself so as to bring each longitudinal marginal edge into mutually opposed relation with itself and with marginal edges of each of said dart cuts being in mutually opposed relation, and e) securing said mutually opposed longitudinal marginal edges and dart cut edges together by at least one flatlock seam so as to form a sock having a foot receiving portion and a leg encompassing portion, said flatlock seam also securing said longitudinal and dart cut marginal edges of said second blank to the corresponding marginal edges of the first blank so as to form a double layer padded area on the sock adjacent a toe or heel of the foot receiving portion of the sock.

2. The method as defined in claim 1 wherein said second blank is secured to said first blank so as to extend about the toe of the foot receiving portion of the sock, said second blank having a longitudinal length sufficient to both underlie and overlie the toe area of a wearer's foot when inserted into the sock.

3. The method as defined in claim 2 wherein said second blank is formed with a longitudinal length so that the second blank extends from the toe of the sock along a sole portion to underlie the ball of a wearer's foot.

4. The method as defined in claim 1 wherein said second blank is secured to said first blank so as to extend about the heel of the foot receiving portion of the sock, said second blank having a longitudinal length sufficient to underlie the heel of a wearer's foot and extend upwardly along the rear of the wearer's ankle.

5. The method as defined in claim 2 including the further steps of forming a third single-piece blank of polyester fleece material having laterally opposite longitudinal marginal edges and a pair of laterally opposite dart cuts formed in said marginal edges so as to enable said third blank to be placed in superimposed relation on said first blank with the longitudinal marginal edges and dart cuts of said third blank in juxtaposed relation with longitudinal marginal edges and a second pair of dart cuts on said first blank, said third blank having substantially transverse marginal end edges, positioning said third blank in said superimposed relation on said first blank and securing said end edges to said first blank by stitched seams disposed generally transverse to said longitudinal marginal edges on said first blank, and securing said juxtaposed marginal longitudinal and dart cut edges of said third and first blanks together by at least one flatlock seam so as to form a double layer padded area on the sock adjacent the heel of the sock.

6. The method as defined in claim 1 including the steps of forming an additional blank of fleece material having a transverse width substantially equal to the transverse width of said first blank and having generally parallel longitudinal marginal edges and transverse end edges, and securing said additional blank in superimposed relation on said first blank by flatlock stitching so that said additional blank extends about a forward facing upper region of said leg encompassing portion of the sock.

7. A sock made in accordance with the method of claim 1.

8. A sock made in accordance with the method of claim 6.

9. The method of claim 1 wherein said first pair of laterally aligned dart cuts are each defined by generally V-shaped marginal edges which intersect their corresponding longitudinal marginal edge through convexly curved corner edges, said first dart cuts defining curved lateral margins of a toe pocket of the sock.

10. The method of claim 9 wherein said second pair of laterally aligned dart cuts are each defined by a generally V-shaped marginal edge, said second pair of dart cuts defining the lateral margins of a heel pocket of the sock.

11. The method as defined in claim 1 wherein said blank is formed with substantially transverse end edges which are disposed in juxtaposed relation when said blank is formed to establish said leg encompassing portion, and including the step of securing an annular elastic band to said juxtaposed transverse end edges.

12. The method of claim 1 wherein said mutually opposed edges of said first pair of dart cuts form lateral marginal edges of a toe pocket, said flatlock seams each extending continuously from the toe pocket to mutually opposed transverse end edges of the first blank.

13. A padded sock made from a first single-piece generally rectangular blank of spun polyester fleece material having generally parallel longitudinal marginal edges and first and second pairs of laterally opposed generally V-shaped dart cuts formed in said longitudinal marginal edges so as to define a sole panel between said pairs of dart cuts, said rectangular blank being formed about transverse fold lines defined between said dart cuts such that the longitudinal marginal edges and marginal edges of said dart cuts are in mutually juxtaposed relation and secured together by at least one flatlock seam, a second single-piece blank of fleece material having longitudinal marginal edges secured to longitudinal edges of said first blank by said flatlock seam so that said second blank extends about a toe end of the sock to overlie and underlie a wearer's foot when disposed within the sock, and a third single-piece blank of fleece material having longitudinal marginal edges secured to the longitudinal marginal edges of the first blank by said flatlock seam so that said third blank extends below a heel portion of the sock and upwardly along a portion of the sock covering the rear of the wearer's ankle.

14. A padded sock as defined in claim 13 including a fourth single-piece blank of fleece material having longitudinal marginal edges secured to longitudinal marginal edges of said first blank by said flatlock seam so that said fourth blank overlies the shin portion of a wearer's leg.

15. A padded sock as defined in claim 14 wherein said second, third and fourth blanks have generally transverse marginal ends edges secured to said first blank by flatlock seams.

16. A padded sock as defined in claim 13 wherein said second and third blanks each have a pair of laterally opposed generally V-shaped dart cuts formed in their longitudinal marginal edges and sized so as to lie in juxtaposed relation to said dart cuts in said first blank, said flatlock seam securing together the juxtaposed marginal edges of the V-shaped dart cuts of said first, second and third blanks.

* * * * *